US008091147B2

(12) United States Patent
Solowey

(10) Patent No.: US 8,091,147 B2
(45) Date of Patent: Jan. 10, 2012

(54) SYSTEM FOR ADJUSTING THE LENGTH OF A GARMENT

(76) Inventor: Rikki A. Solowey, New York, NY (US)

( * ) Notice: Subject to any disclaimer, the term of this patent is extended or adjusted under 35 U.S.C. 154(b) by 400 days.

(21) Appl. No.: 12/361,283

(22) Filed: Jan. 28, 2009

(65) Prior Publication Data

US 2009/0205112 A1 Aug. 20, 2009

Related U.S. Application Data

(60) Provisional application No. 61/028,659, filed on Feb. 14, 2008.

(51) Int. Cl.
*A41D 27/10* (2006.01)

(52) U.S. Cl. ..... 2/269

(58) Field of Classification Search ..... 2/217, 222, 2/269, 270, 231, 232, 233, 59, 60; 160/349.1, 160/349.2, 383, 384, 387, 348
See application file for complete search history.

(56) References Cited

U.S. PATENT DOCUMENTS

| | | | | |
|---|---|---|---|---|
| 150,278 | A * | 4/1874 | Blackwood | 2/217 |
| 172,072 | A * | 1/1876 | Baker | 2/217 |
| 610,031 | A * | 8/1898 | Conkling et al. | 2/217 |
| 823,534 | A | 6/1906 | Hutchinson | |
| 2,127,763 | A * | 8/1938 | Bentz | 2/85 |
| 2,493,545 | A * | 1/1950 | Muyleart | 2/70 |
| 2,524,814 | A | 10/1950 | Leaf | |
| 2,687,532 | A * | 8/1954 | Menz et al. | 2/240 |
| 4,149,275 | A | 4/1979 | Sanchez | |
| 4,200,938 | A | 5/1980 | LeTourneau | |
| 4,697,288 | A | 10/1987 | Palumbo | |
| 4,985,936 | A | 1/1991 | Jones | |
| 5,088,128 | A | 2/1992 | Kape | |
| 5,539,932 | A | 7/1996 | Howard | |
| 5,575,010 | A | 11/1996 | Chung | |
| 6,282,717 | B1 * | 9/2001 | Ng | 2/70 |
| 2006/0277660 | A1 | 12/2006 | MacMillan | |
| 2007/0169250 | A1 | 7/2007 | Maniguet | |
| 2007/0245460 | A1 | 10/2007 | Ryan et al. | |

FOREIGN PATENT DOCUMENTS

| | | | |
|---|---|---|---|
| JP | 2004-353098 | A | 12/2004 |
| JP | 2006-052495 | A | 2/2006 |

OTHER PUBLICATIONS

Zakkerz, "Picture This" and "How to Use," http://www.zakkerz.com/products.html and http://www.zakkerz.com/products_html (date retreived Jan. 28, 2009).

* cited by examiner

*Primary Examiner* — Alissa L Hoey
*Assistant Examiner* — Amber Anderson
(74) *Attorney, Agent, or Firm* — Weitzman Law Offices, LLC

(57) ABSTRACT

A garment hem adjustment system and method, comprising a plurality of fasteners mounted on a surface of a garment proximal to the hem of the garment. The fasteners are aligned in a first column along an inseam of the garment and in a second column along an outseam of the garment. The fasteners are spaced apart a predetermined distance corresponding to a desired adjustment of the garment hem. The lowermost fastener in the first and second columns is adapted to releasably connect to the remaining fasteners in the column. Means are provided for preventing the garment hem from sagging between the columns of fasteners when the lowermost fastener in each column is releasably connected to another fastener in the column.

12 Claims, 7 Drawing Sheets

SYSTEM FOR ADJUSTING THE LENGTH OF A GARMENT

CROSS-REFERENCE TO RELATED APPLICATION

This application claims the benefit of U.S. Provisional Patent Application No. 61/028,659, filed Feb. 14, 2008, the entire disclosure of which is incorporated by reference herein.

FIELD

This application relates generally to garments, and more particularly, to an improved system for readily adjusting the length of a garment.

BACKGROUND

Garments, such as pants, skirts, and shirt sleeves, are generally adjusted by stitching or cutting. Adjusting hems on pant legs, for example, requires manual alteration of the garment by cutting the stitches, unfolding the cuff, resetting the cuff to a desired length, and re-stitching the hem. Traditional manual stitching operations are time consuming and prone to errors. Moreover, alterations of garments as described above are permanent unless the garment is altered again.

Unfortunately, such permanent alterations do not address the many different contexts in which a garment may be worn. For instance, trousers or slacks may be worn with different types of shoes (e.g., high heels, flats, boots, sneakers, etc.). The particular shoe to be worn will, in turn, dictate the desired length of the trousers or slacks. For example, the length of a pair of trousers or slacks will need to be longer for a shoe with high heels than for a flat shoe with little or no heel. A user may have to have the trousers or slacks hemmed by a tailor to the desired length dictated by the particular type of shoe the user intends to wear with the garment. That length, however, may not correspond to the length dictated by a different type of shoe.

There have been previous attempts at facilitating garment hem adjustments, which generally included systems embedded in the garment. Some of these attempts were not aesthetically pleasing and/or were difficult to use, while others were uncomfortable for the person wearing the garment.

It is, therefore, desirable to have a system for readily adjusting the length of a garment that is efficient, aesthetically pleasing, and comfortable to wear.

SUMMARY

In one aspect of this disclosure, a garment hem adjustment system and method are disclosed comprising a plurality of fasteners mounted on a surface of a garment proximal to the hem of the garment. The fasteners are aligned in a first column along an inseam of the garment and in a second column along an outseam of the garment. The fasteners are spaced apart a predetermined distance corresponding to a desired adjustment of the garment hem. The lowermost fastener in the first and second columns is adapted to releasably connect to the remaining fasteners in the column. Means are provided for preventing the garment hem from sagging between the columns of fasteners when the lowermost fastener in each column is releasably connected to another fastener in the column.

In another aspect of this disclosure, a pulley system is provided for preventing the garment hem from sagging between the columns of fasteners when the lowermost fastener in each column is releasably connected to another fastener in the column. The pulley system comprises a plurality of rings located on the garment surface proximal to the garment hem. The rings are aligned in at least two rows between the first and second columns. A drawstring extends through the rings so that tension exerted on at least one end of the drawstring causes the garment hem between the columns of fasteners to be drawn up evenly against the garment surface to prevent the hem from sagging when the lowermost fastener in each column is releasably connected to another fastener in the column.

In still another aspect of this disclosure, at least one malleable member is attached to the garment proximal the garment hem and between the inseam and outseam of the garment to prevent the garment hem from sagging when the lowermost fastener in each column is releasably connected to another fastener in the column.

In yet another aspect of this disclosure, at least one elastic strip is attached to the garment proximal the garment hem and between the inseam and outseam of the garment. The elastic strip has at least one free end terminating in a strip fastener. The strip fastener is adapted to releasably connect to another fastener to prevent the garment hem from sagging when the lowermost fastener in each column is releasably connected to another fastener in the column.

In another aspect of this disclosure, a cord is attached to the garment proximal the garment hem between the inseam and outseam. The cord has a first end proximal the inseam and a second end proximal the outseam. Each end of the cord terminates in a cord fastener, which is adapted to releasably connect to another fastener to prevent the garment hem from sagging between the inseam and outseam when the lowermost fastener in each column is releasably connected to another fastener in the column.

These and other advantages of the present disclosure will be apparent to those of ordinary skill in the art by reference to the following detailed description and the accompanying drawings.

DETAILED DESCRIPTION

Various embodiments of a system for readily adjusting the length of a garment (e.g., pants, skirt, shirt or jacket sleeve, etc.) are disclosed herein. The disclosed systems may be fixed to or otherwise incorporated on the front and/or back inside surface of the garment to permit the wearer of the garment to adjust its length to a desired position. While embodiments of the garment length adjusting system are described below in terms of adjusting the hem or length of a pair of trousers, it is understood that the disclosed system is not limited to adjusting the length of trousers and may be utilized to adjust the length of other garments, such as for example a skirt or sleeves on a shirt, jacket or coat.

Figure 1:
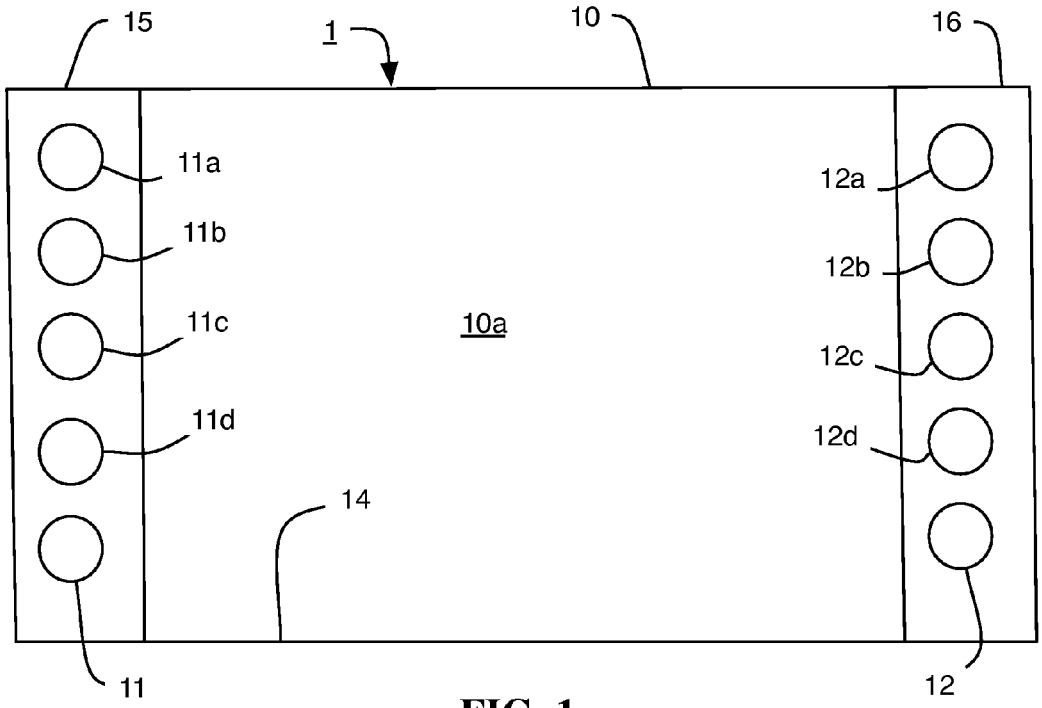
FIG. 1 illustrates a garment length adjustment system incorporated on the inside surface of a garment.

FIG. 1 illustrates a preferred garment length adjustment system 1 incorporated on the inside surface 10*a* of a garment, such as, for example, the hem 14 on pant leg 10. The pant leg 10 preferably includes an inseam 15 and an outseam 16, which are the seams that bind the length of the inner and outer pant leg, respectfully. Two columns of fasteners or snaps 11, 11*a*, 11*b*, 11*c*, 11*d* and 12, 12*a*, 12*b*, 12*c*, 12*d* are preferably secured on the inside 10*a* of the pant leg 10 near the hem 14. The fasteners are preferably ball and socket snaps or snap fasteners, but they may also be other conventional fasteners such as Velcro, hooks and eyes, and the like. The snaps 11, 11*a*, 11*b*, 11*c*, 11*d* and 12, 12*a*, 12*b*, 12*c*, 12*d* may be secured to the pant leg 10 in a conventional manner, such as by sewing or through use of a mechanical attachment. Alternatively, each column of snaps 11, 11*a*, 11*b*, 11*c*, 11*d* and 12, 12*a*, 12*b*, 12*c*, 12*d* may be secured to a strip of cloth material, which may then be sewn, glued, ironed or otherwise secured to the inseam 15 and outseam 16 of the pant leg.

The lowermost snap 11 in the first column may releasably connect to the remaining snaps 11*a*, 11*b*, 11*c*, 11*d* in the first column, and the lowermost snap 12 in the second column may releasably connect to the remaining snaps 12*a*, 12*b*, 12*c*, 12*d* in the second column. Therefore, if snaps 11*a*, 11*b*, 11*c*, 11*d* and 12*a*, 12*b*, 12*c*, 12*d* are male snaps (e.g., the ball portion of a ball and socket connector), the snaps 11, 12 would be the opposite and vice versa.

The snaps in each column are spaced apart a predetermined distance, which corresponds to the amount of length adjustment desired. In addition, snaps in each column (e.g., snaps 11, 12; snaps 11*d*, 12*d*; snaps 11*c*, 12*c*; snaps 11*b*, 12*b*; snaps 11*a*, 12*a*) are preferably the same distance from the hem 14.

Figure 2:
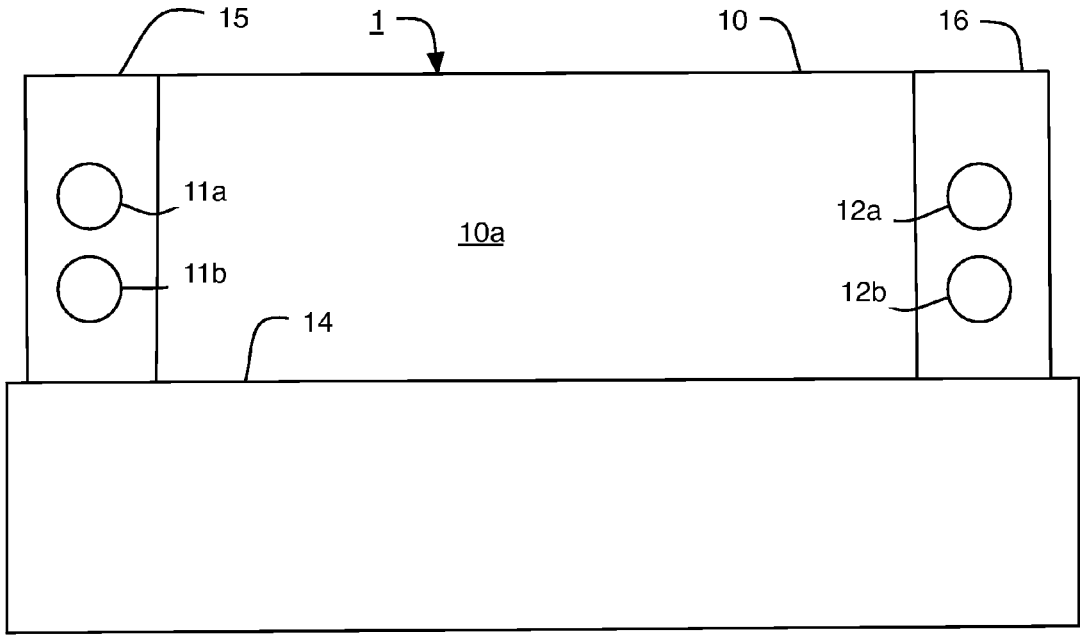
FIG. 2 illustrates the garment length adjustment system of FIG. 1 with the garment adjusted to a shorter length.

FIG. 2 illustrates the garment (e.g., pant leg 10) in FIG. 1 after the hem 14 has been adjusted to a desired length using garment length adjustment system 1. The hem 14 of the pant leg 10 is folded upward so that the snaps 11, 12 releasably engage one of the corresponding snaps in each column. For example, FIG. 2 illustrates snaps 11, 12 releasably connected to snaps 11*c*, 12*c*, respectively.

While the preferred system 1 is illustrated as having a total of five snaps in each column, it is understood that this number is exemplary and that a greater or lesser number of snaps may be used with the disclosed system. Snaps 11, 11*a*, 11*b*, 11*c*, 11*d* and 12, 12*a*, 12*b*, 12*c*, and 12*d* are preferably made from plastic, metal, or any other suitable material. Pant leg 10 may be made of any fabric or blend of fabrics.

Figure 3:
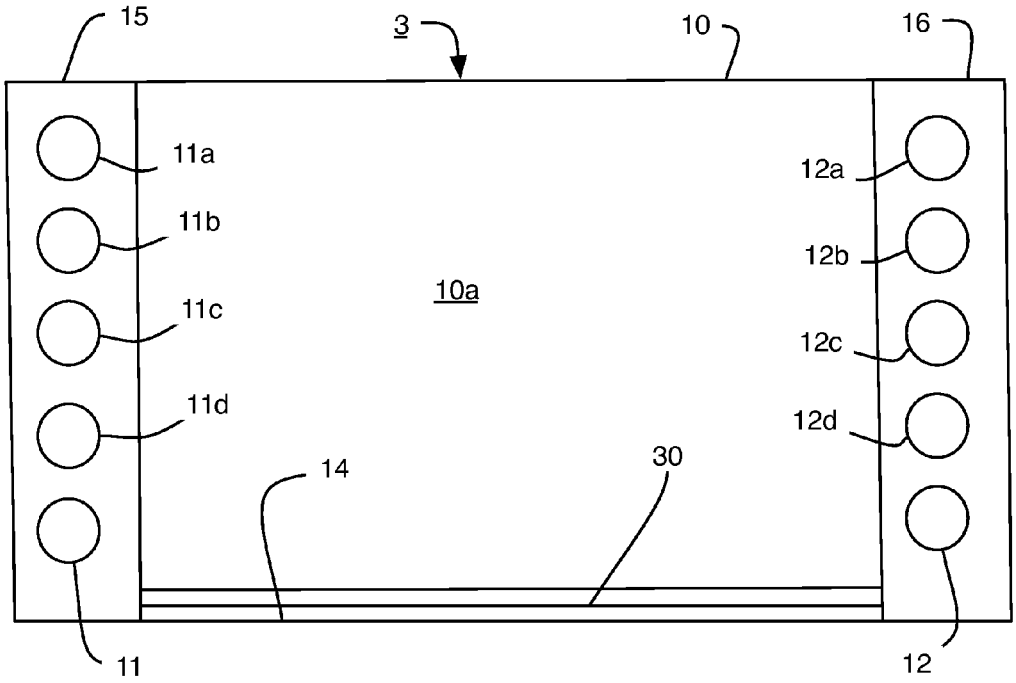
FIG. 3 illustrates another embodiment of a garment length adjustment system incorporated on the inside surface of a garment.
Figure 4:
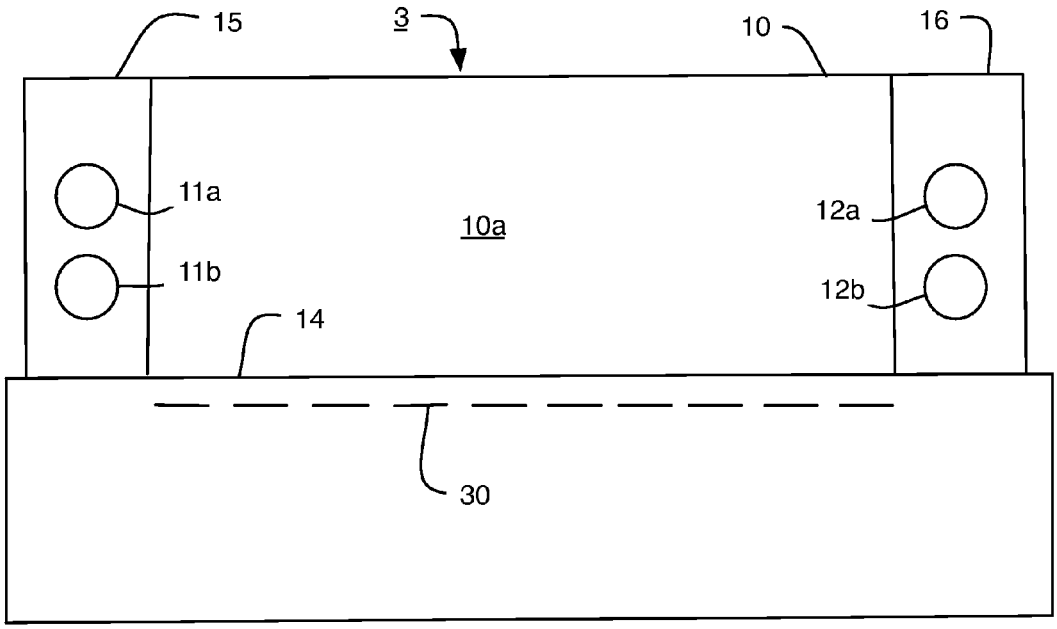
FIG. 4 illustrates the garment length adjustment system of FIG. 3 with the garment adjusted to a shorter length.

Another embodiment of the garment length adjustment system 3 is illustrated in FIGS. 3 and 4. The adjustment system 3 is similar to adjustment system 1 illustrated in FIGS. 1 and 2, but also includes one or more members or wires 30 preferably made of malleable material that can be embedded or otherwise affixed to the front and/or back inside surface of the pant leg 10 near the hem 14 to maintain the shape of the hem. Alternatively, wire 30 may be embedded into a fabric that is attached to the front and/or back inside surface of the pant leg 10 near the hem 14. Wire 30 makes the pant leg 10 more aesthetically pleasing after adjustment of the length by preventing the hem 14 from sagging between the inseam 15 and outseam 16 when the garment is worn by the user.

Figure 5:
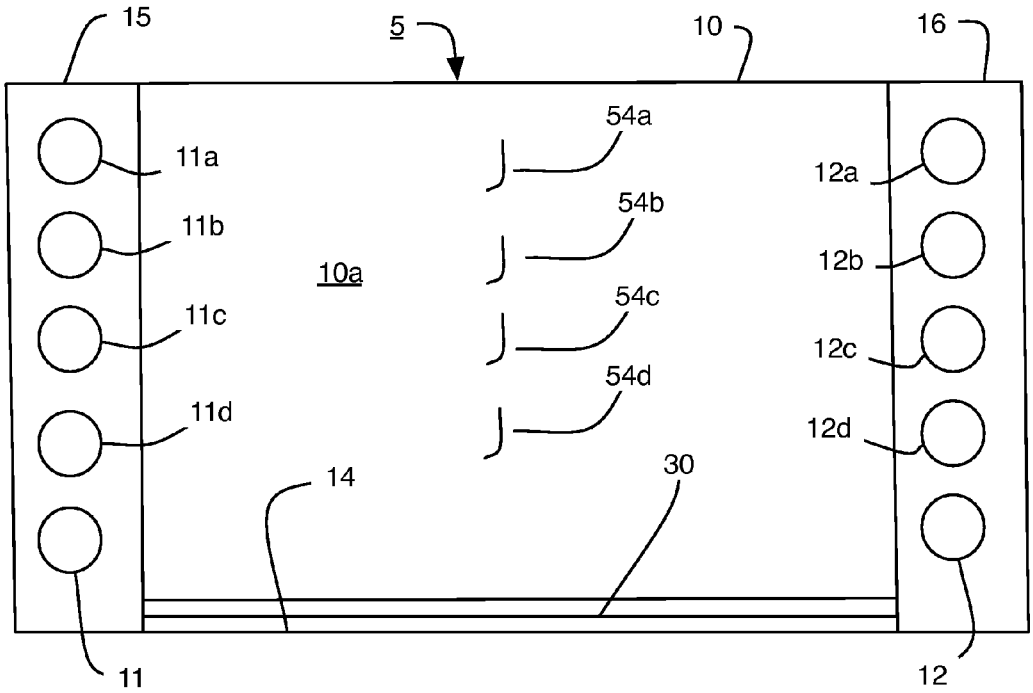
FIG. 5 illustrates another embodiment of a garment length adjustment system incorporated on the inside surface of a garment.
Figure 6:
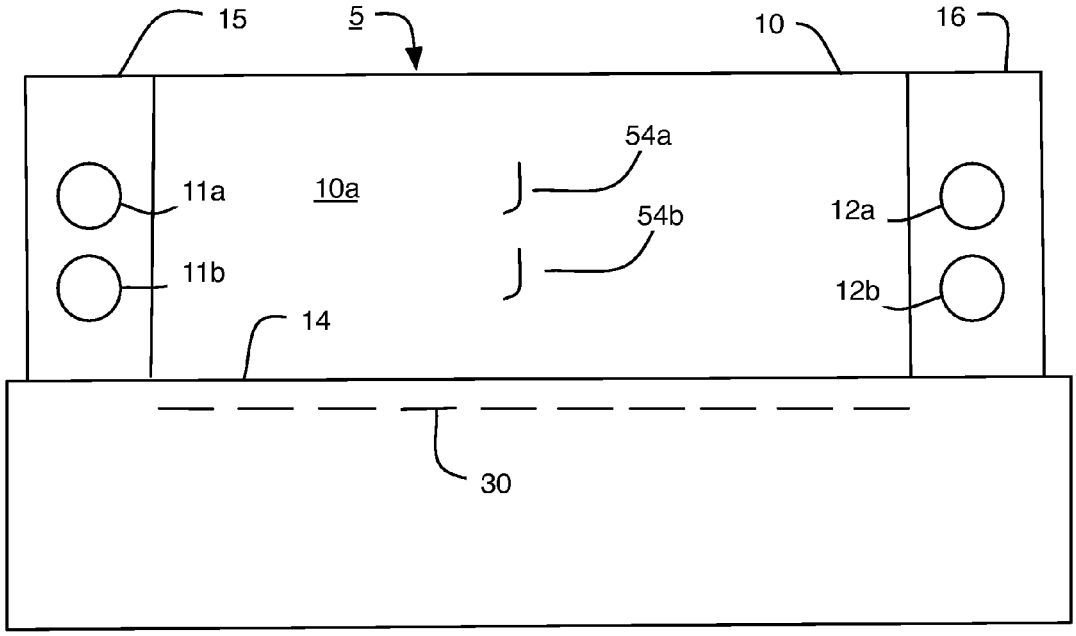
FIG. 6 illustrates the garment length adjustment system of FIG. 5 with the garment adjusted to a shorter length.

Another embodiment of the garment length adjustment system 5 is illustrated in FIGS. 5 and 6. The adjustment system 5 is similar to the adjustment system 3 illustrated in FIGS. 3 and 4, but also includes a column of hooks 54*a*, 54*b*, 54*c*, 54*d* fixed on the front and/or back inside surface 10*a* of pant leg 10 between inseam 15 and outseam 16. The hooks 54*a*, 54*b*, 54*c*, 54*d* can be mounted in the middle and/or back of the pant leg 10. Each hook 54*a*, 54*b*, 54*c*, 54*d* is preferably at approximately the same height as a corresponding row of snaps 11*a*, 12*a*; 11*b*, 12*b*; 11*c*, 12*c*; and 11*d*, 12*d*. The wire 30 or an eye (not shown) affixed to the hem 14 can be placed on the desired hook 54*a*, 54*b*, 54*c*, 54*d* to keep the front and back of the pant leg 10 at the desired height. The wire 30 may be partially embedded so that the exposed portions of the wire 30 can selectively engage the desired hook 54*a*, 54*b*, 54*c*, 54*d*.

FIG. 6 illustrates the garment (e.g., pant leg 10) in FIG. 5 after the hem 14 has been adjusted to a desired length using garment length adjustment system 5 with a portion of the wire 30 engaging either hook 54*c* or 54*d* to minimize or prevent sagging of the hem 14 between the inseam 15 and outseam 16.

Figure 7:
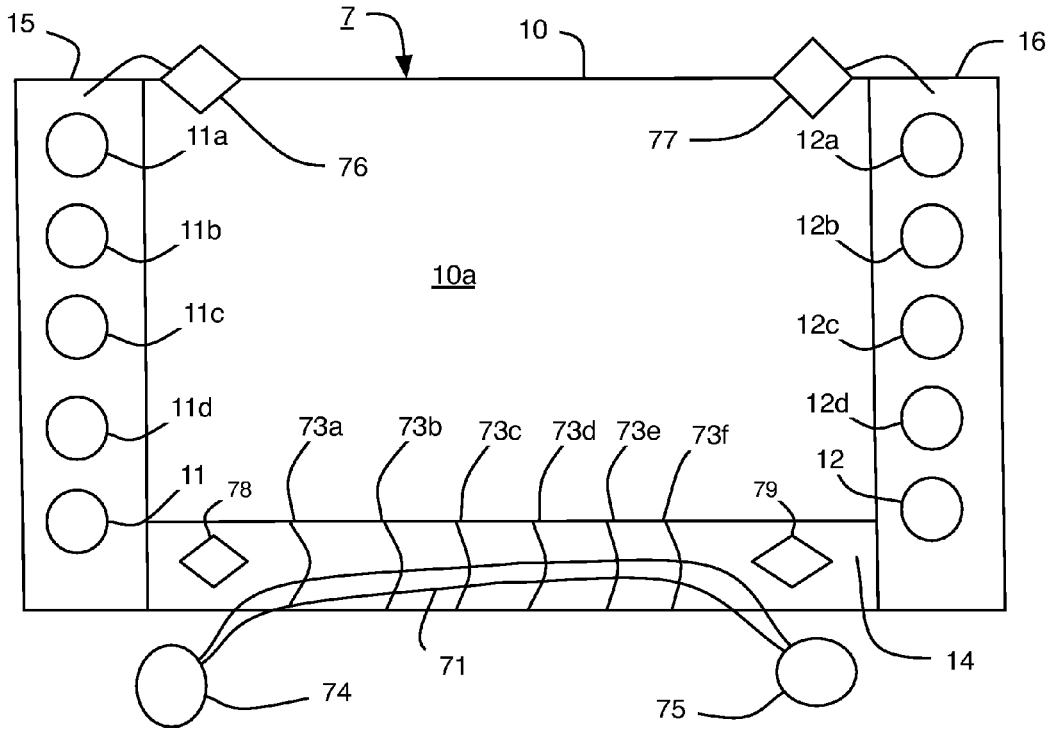
FIG. 7 illustrates another embodiment of a garment length adjustment system incorporated on the inside surface of a garment.
Figure 8:
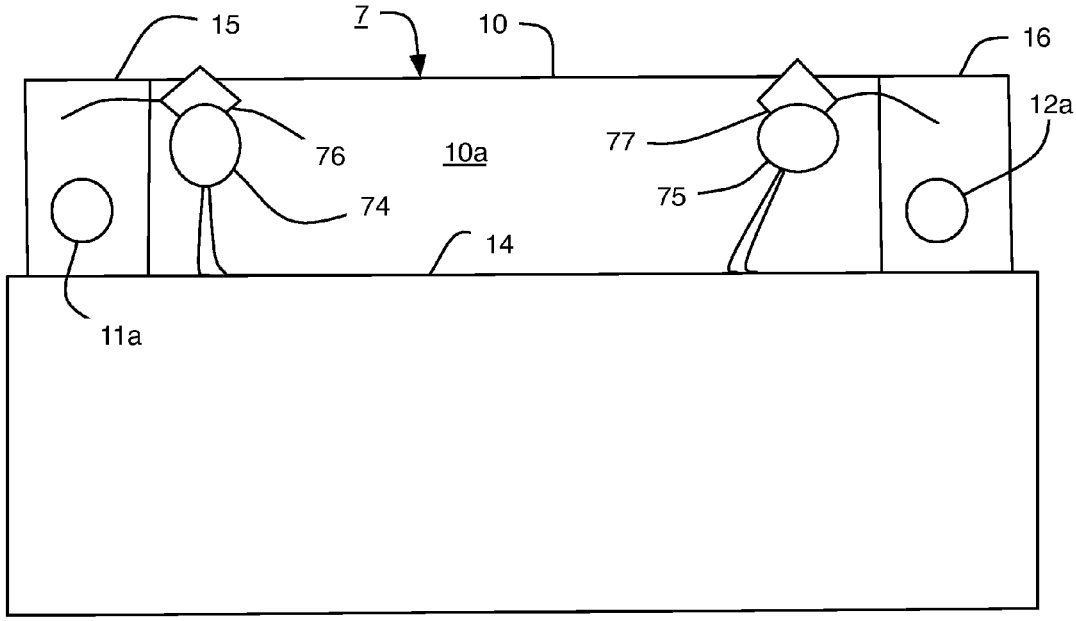
FIG. 8 illustrates the garment length adjustment system of FIG. 7 with the garment adjusted to a shorter length.

Another embodiment of the garment length adjustment system 7 is illustrated in FIGS. 7 and 8. The adjustment system 7 is similar to the adjustment system 1 illustrated in FIGS. 1 and 2, but also includes a row of loops 73*a*, 73*b*, 73*c*, 73*d*, 73*e*, 73*f* affixed to the front and/or back inside surface 10*a* of the pant leg 10 along the hem 14 between the inseam 15 and outseam 16. The number of loops 73*a*, 73*b*, 73*c*, 73*d*, 73*e*, 73*f* shown in FIG. 7 are exemplary and can be adjusted as necessary. Loops 73*a*, 73*b*, 73*c*, 73*d*, 73*e*, 73*f* are preferably metallic loops that are affixed to the front and/or back inside surface 10*a* of the pant leg 10 in a conventional manner. Alternatively, the loops 73*a*, 73*b*, 73*c*, 73*d*, 73*e*, 73*f* can be secured to a strip of cloth material, which may then be sewn, glued, ironed, or otherwise secured along the hem 14 between the inseam 15 and outseam 16 of the pant leg 10.

A cord 71 passes through the loops 73*a*, 73*b*, 73*c*, 73*d*, 73*e*, 73*f* on the front, inside surface 10*a* of the pant leg 10 and a separate cord 71 passes through the loops 73*a*, 73*b*, 73*c*, 73*d*, 73*e*, 73*f* on the rear, inside surface of the pant leg. The cord 71 may be made from string, rope, elastic, or any other suitable material capable of applying tension to the adjustment system 7. A ring 74, 75 is attached to each end of the cord 71, which prevents the cord 71 from being pulled through loops 73*a*, 73*b*, 73*c*, 73*d*, 73*e*, 73*f*. Rings 74, 75 may be metallic or any other suitable material. A clasp 76, 77 is preferably affixed to the inseam 15 and outseam 16 for releasably engaging the rings 74, 75. The clasps 76, 77 may be affixed directly to the pant leg 10 in a conventional manner, such as sewing, or indirectly via a rope, elastic, chain or other suitable material. The clasps 76, 77 may also be affixed to a cloth material that is affixed to the pant leg 10 in a conventional manner. It is understood that the clasps 76, 77 and rings 74, 75 may be reversed so that the clasps are attached to the ends of the cord 71 and the rings are affixed to the inseam 15 and outseam 16. Resting snapplets or clasps 78, 79 may optionally be provided to releasably engage with rings 74, 75 so that the rings do not hang below the hem when they are not releasably engaged with clasps 76, 77.

The length of the hem 14 may be adjusted to a desired length as described above with respect to the adjustment system 1 illustrated in FIGS. 1 and 2 by folding the original hem 14 upwards so that the snaps 11, 12 releasably engage one of the corresponding snaps in each column on the inseam 15 and outseam 16. As illustrated in FIG. 8, each ring 74, 75 is then releasably connected to a corresponding clasp 76, 77 affixed to the inseam 15 and outseam 16. The string/rope/elastic 71 will be pulled tighter through the loops 73*a*, 73*b*, 73*c*, 73*d*, 73*e*, 73*f* to maintain the hem 14 at the desired length and prevent or minimize the hem 14 from sagging between the inseam 15 and outseam 16. Additional clasps may be incorporated into the adjustment system 7 to releasably engage the rings 74, 75 to, for example, retain the cord 71 in a resting position.

Figure 9:
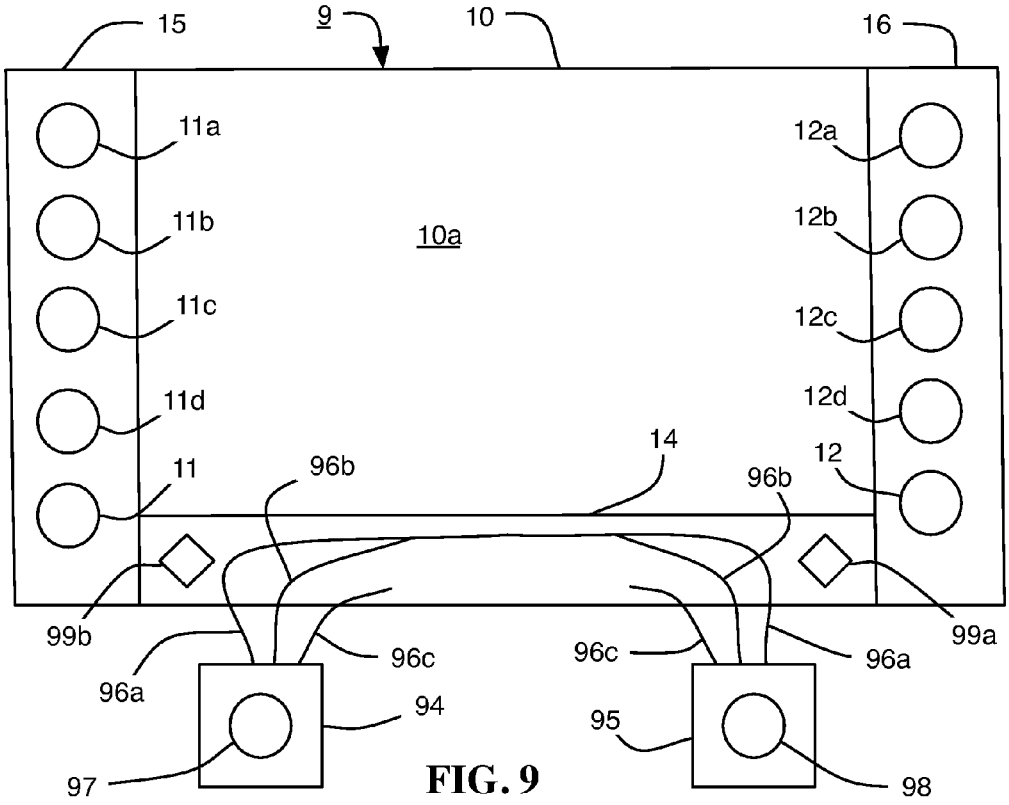
FIG. 9 illustrates another embodiment of a garment length adjustment system incorporated on the inside surface of a garment.
Figure 10:
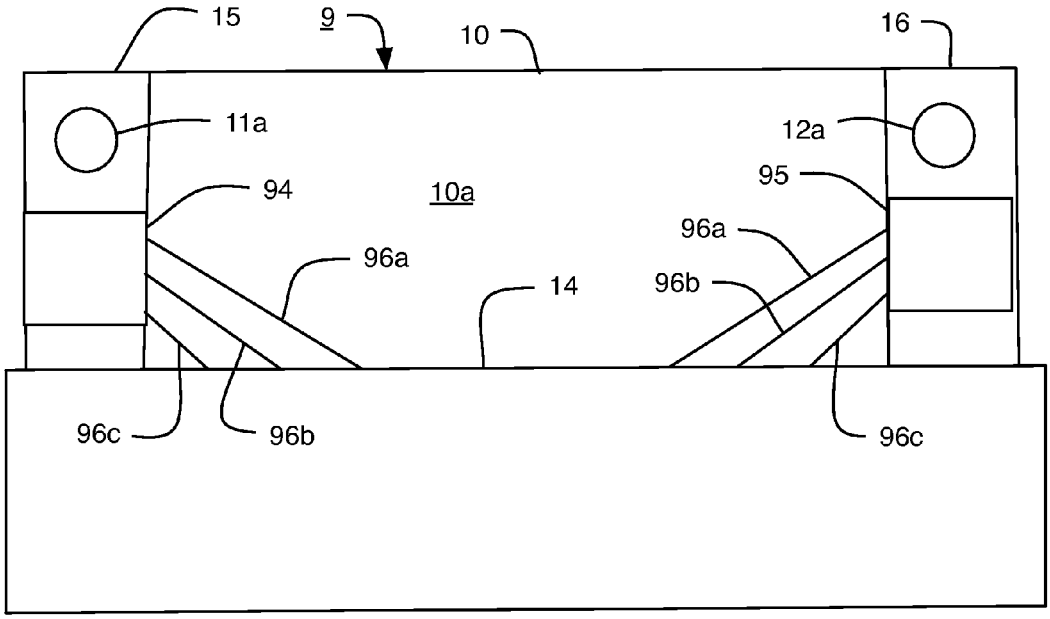
FIG. 10 illustrates the garment length adjustment system of FIG. 9 with the garment adjusted to a shorter length.

Another embodiment of the garment length adjustment system 9 is illustrated in FIGS. 9 and 10. The adjustment system 9 is similar to the adjustment system 1 illustrated in FIGS. 1 and 2, but preferably includes two fasteners or snaps 97, 98. Snaps 97, 98 are preferably of the same type as snaps 11, 12 in the two column of snaps so that snaps 97, 98 may releasably connect to a corresponding snap 11*a*, 11*b*, 11*c*, 11*d*, 12*a*, 12*b*, 12*c*, 12*d* in the two columns of snaps. The snaps 97, 98 are connected to the front and/or back inner surface 10*a* of the pant leg 10 near the bottom of the hem 14 via elastic strips 96*a*, 96*b*, 96*c*. It is understood that the number of elastic strips disclosed herein and their placement are exemplary and that other numbers of elastic strips may be utilized with the adjustment system disclosed herein. The snaps 97, 98 may be mounted on pieces of fabric 94, 95, which are attached to elastic strips 96*a*, 96*b*, 96*c*. The elastic strips 96*a*, 96*b*, 96*c* can be secured directly to the front and/or back inner surface 10*a* of the pant leg 10, or to a strip of cloth material, which may then be sewn, glued, ironed, or otherwise secured along the hem 14 between the inseam 15 and outseam 16 of the pant leg 10.

FIG. 10 illustrates the garment length adjustment system 9 of FIG. 9 with the garment 10 adjusted to an exemplary length. The length of the hem 14 may be adjusted to a desired length as described above with respect to the adjustment system 1 illustrated in FIGS. 1 and 2 by folding the original hem 14 upwards so that the snaps 11, 12 releasably engage one of the corresponding snaps in each column on the inseam 15 and outseam 16. In the example illustrated in FIG. 10, snap 11 releasably engages snap 11*c* and snap 12 releasably engages snap 12*c* when the hem 14 is folded upwards. Snaps 97, 98 are then releasably connected to a corresponding snap in the two columns of snaps, which causes the elastic strips 96*a*, 96*b*, 96*c* to stretch. This serves to maintain the hem 14 at the desired length and prevent or minimize the hem 14 from sagging between the inseam 15 and outseam 16. Preferably, the snaps 97, 98 are releasably connected to the snap in each column immediately above the snap that is engaging snaps 11, 12. Resting snapplets 99*a*, 99*b* may optionally be provided to releasably engage with snaps 97, 98 so that the snaps do not hang below the hem when they are not releasably engaged with snaps 11*a*, 11*b*, 11*c*, 11*d*, 12*a*, 12*b*, 12*c*, 12*d*.

Figure 11:
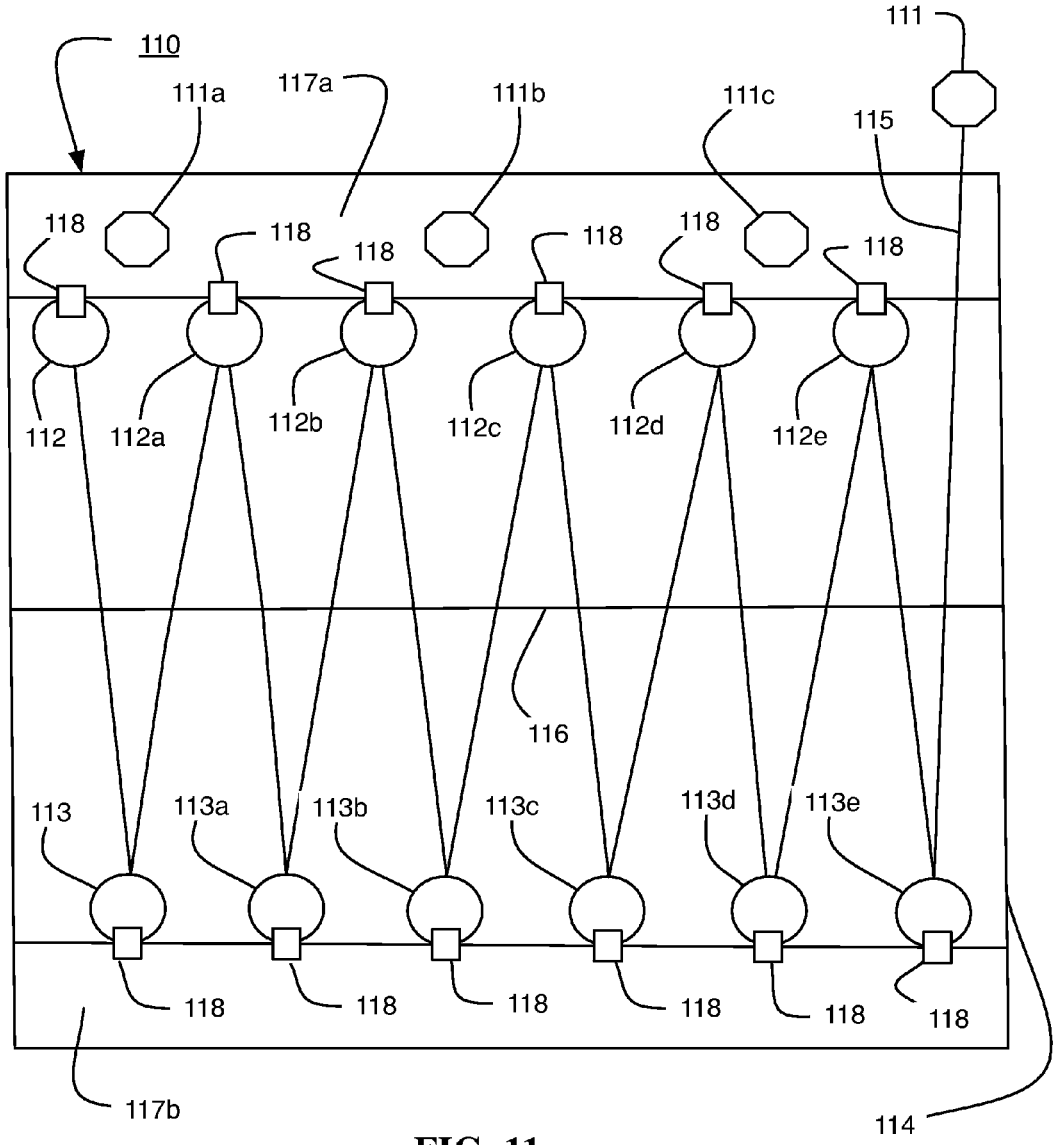
FIG. 11 illustrates another embodiment of the garment length adjustment system.

FIG. 11 illustrates another embodiment of the garment length adjustment system 110 that can be affixed directly or indirectly to the inner surface of a garment (not shown) to adjust the hem to a desired length. While the system 110 described below can be affixed directly to the inner surface of the garment, it is preferred that the system 110 be assembled on a strip of cloth, fabric or any suitable material, which may then be sewn, glued or otherwise secured along the hem of the garment.

To assemble the garment length adjustment system 110, two rows of spaced apart rings 112, 112*a*, 112*b*, 112*c*, 112*d*, 112*e* and 113, 113*a*, 113*b*, 113*c*, 113*d*, 113*e* are preferably mounted on opposing sides of a fabric 114, which may be, for example, a six inch wide tear away fabric. Each row of rings can initially be captured in a ring tape 117*a*, 117*b*, such as, for example, a ⅞ inch twill tape ribbon that is folded down ⅜ inch. The rings 112, 112*a*, 112*b*, 112*c*, 112*d*, 112*e* and 113, 113*a*, 113*b*, 113*c*, 113*d*, 113*e* in each row are preferably spaced apart a predetermined distance (e.g., one inch) and can be attached to the ring tape 117*a*, 117*b* in a conventional manner, such as, for example, using ¼ inch or ⅛ inch ribbon loops 118. The rings 112, 112*a*, 112*b*, 112*c*, 112*d*, 112*e* and 113, 113*a*, 113*b*, 113*c*, 113*d*, 113*e* may be made from plastic, metal or any other suitable material. In the preferred embodiment, ½ inch plastic rings are utilized.

The ring tape 117*a*, 117*b* is then attached to opposing sides of the fabric 114 in a conventional manner, such as, for example, by sewing the ring tape to the fabric with a tear away chain stitch. The two rows of rings 112, 112*a*, 112*b*, 112*c*, 112*d*, 112*e* and 113, 113*a*, 113*b*, 113*c*, 113*d*, 113*e* are preferably offset by a predetermined distance relative to one another.

Snaps 111*a*, 111*b*, 111*c* are preferably affixed to the ring tape 117*a* and/or fabric 114 above the row of rings 112, 112*a*, 112*b*, 112*c*, 112*d*, 112*e*. The snaps 111*a*, 111*b*, 111*c* are preferably flat plastic female lingerie snaps, which are preferably set about two inches apart from one another. The number of rings and snaps illustrated in FIG. 11 is exemplary and it is understood that a greater or lesser number of rings and snaps may be utilized with the adjustment system 110.

The rings 112, 112*a*, 112*b*, 112*c*, 112*d*, 112*e* and 113, 113*a*, 113*b*, 113*c*, 113*d*, 113*e* are preferably inter-connected by a drawstring cord 115, which may be, for example, a ¼ inch or ⅛ inch lacing cord. A fastener or snap 111 is provided at the end of the cord 115. The snap 111 can releasably connect to the snaps 111*a*, 111*b*, 111*c*. For example, the snap 111 may be a ¼ inch flat plastic male lingerie snap and the snaps 111*a*, 111*b*, 111*c* can be ¼ inch flat plastic female lingerie snaps.

A chain 116, preferably made of metal, may be set loosely across the center of the fabric 114. The chain 116 is preferably covered in fabric (e.g., encased in a polyurethane coated silk type fabric) to prevent discoloration of the garment. The chain 116 functions as a weight for the garment length adjustment system 110.

The face of the assembled adjustment system 110 may optionally be finished with, for example, a six inch transparent fabric attached with a chain stitch to tear away after the system 110 is installed on a garment. The transparent fabric and the mounting fabric 114 keep the adjustment system 110 correctly oriented for simple installation.

The assembled garment length adjustment system 110 illustrated in FIG. 11 may be installed on a garment (not shown) as follows. The assembled adjustment system 110 is preferably affixed to the inside surface of the garment near the garment hem in a conventional manner, such as by sewing, gluing or bonding the assembled system to the garment. For example, the bottom edge of the assemble adjustment system 110 can be sewn approximately ⅛ inch from the edge of the hem of a pant leg or other garment using, for example, a blind hem stitch. The top edge of the assembled adjustment system 110 is preferably sewn (as spaced by the transparent fabric) six inches from the hem of the pant leg using, for example, a blind hem stitch.

A snap 111 may be attached to the end of the drawstring cord 115 when the assembled adjustment system 110 is installed on the garment and the cord 115 is flat and without tension. The snap 111 is attached to the top ring tape 117*a* to hold the snap in place. The optional transparent fabric layer can then be torn away and the installed garment length adjustment system 110 is ready for use.

When the garment length adjustment system 110 is installed on a garment, such as a pant leg, the drawstring construction causes the hem to be drawn up evenly against the inside of the garment by pulling on the on the snap 111 and drawstring 111. The snap 111 may be releasably connected to a corresponding snap 111*a*, 111*b*, 111*c* to maintain the garment hem at the desired length. Connecting the snap 111 to the snap closest to it will result in the least adjustment of the garment hem and connecting the snap 111 to the snap furthest from it will result in the greatest adjustment of the garment hem.

As with the other embodiments, the garment length adjustment system 110 may be used in conjunction with the two columns of fasteners or snaps 11, 11*a*, 11*b*, 11*c*, 11*d* and 12, 12*a*, 12*b*, 12*c*, 12*d* illustrated in FIG. 1.

Figure 12:
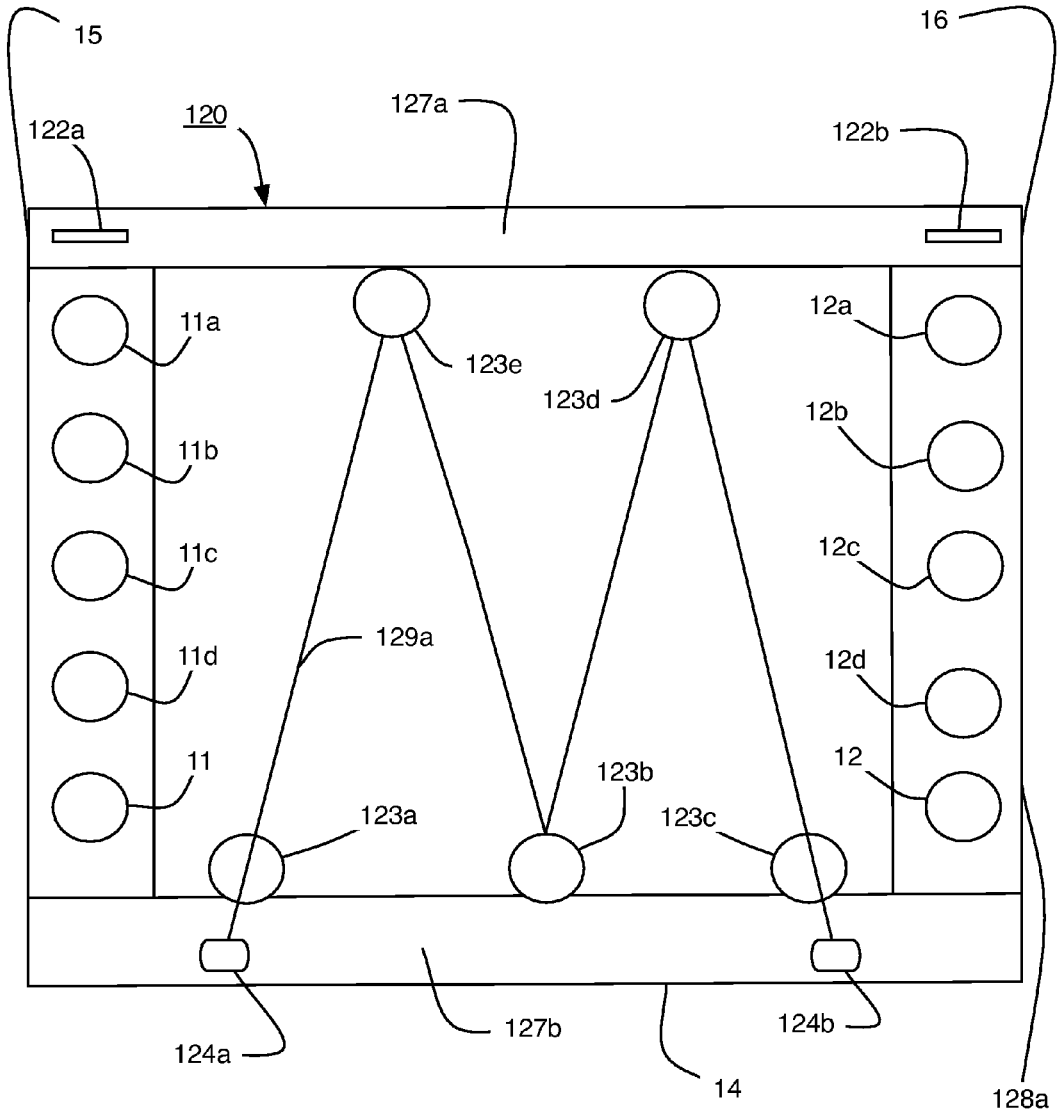
FIG. 12 illustrates another embodiment of the garment length adjustment system.

FIG. 12 illustrates another embodiment of the garment length adjustment system 120 that can be installed directly or indirectly to the front and/or back inner surface of a garment to adjust hem 14 to a desired length. To assemble the garment length adjustment system 120, two rows of spaced apart rings 123*a*, 123*b*, 123*c* and 123*d*, 123*e* are preferably mounted on opposing sides of a fabric 128*a*, which may be, for example, a six inch wide tear away fabric. Each row of rings may initially be captured in a ring tape 127*a*, 127*b*, such as, for example, a ⅞ inch twill tape ribbon that is folded down ⅜ inch. The ring tape 127*a*, 127*b* is then attached to opposing sides of the fabric 128*a* in a conventional manner, such as, for example, by sewing the ring tape to the fabric with a tear away chain stitch.

The two rows of rings are preferably offset by a predetermined distance relative to one another. The rings 123*a*, 123*b*, 123*c* and 123*d*, 123*e* in each row are preferably spaced apart a predetermined distance (e.g., one inch) and can be attached to the ring tape 127*a*, 127*b* in a conventional manner. The rings 123*a*, 123*b*, 123*c* and 123*d*, 123*e* may be made from plastic, metal or any other suitable material.

The rings 123*a*, 123*b*, 123*c*, 123*d*, 123*e* are preferably inter-connected by a drawstring cord 129*a*, which may be, for example, a ¼ inch or ⅛ inch lacing cord. A fastener 124*a*, 124*b* is provided at the end of the cord 129*a* and is preferably large enough to prevent the ends of the cord from being pulled through the rings. The fastener 124*a*, 124*b* can releasably connect to corresponding fastener 122*a*, 122*b*. The corresponding fastener 122*a*, 122*b* may either be affixed directly to the inside surface of the garment or to the fabric 128*a*. If the latter, the corresponding snap 122*a*, 122*b* may be attached in a conventional manner to the ring tape 127*a*. In the preferred embodiment, the fastener 124*a*, 124*b* may be a conventional hook-like device and the corresponding fastener 122*a*, 122*b* may be a corresponding eyelet, loop or any other device designed to releasably engage with 124*a*, 124*b*. It is understood that the fasteners 122*a*, 122*b*, 124*a*, 124*b* may be reversed so that the loop-like fastener 122*a*, 122*b* can positioned at the end of the drawstring and hook-like fasteners 124*a*, 124*b* can be positioned on the inside surface of the garment.

The drawstring cord 129*a* preferably includes one or more conventional slack adjusting mechanisms through which the cord is laced to remove excess slack when the fasteners 124*a*, 124*b* are releasably engaged with the corresponding fasteners 122*a*, 122*b*. The slack adjusting mechanism is preferably located near the ends of the cord 129*a*. The cord 129*a* may be laced through the slack adjusting mechanism so that extra slack may be reduced by doubling the cord back upon itself in the same manner that slack is adjusted on helmets, brassieres and the like.

The adjustment system 120 preferably includes two columns of fasteners or snaps 11, 11*a*, 11*b*, 11*c*, 11*d* and 12, 12*a*, 12*b*, 12*c*, 12*d* similar to those illustrated in FIG. 1. The fasteners may be, for example, ball and socket snaps, snap fasteners, or any other suitable fastener such as Velcro, hooks and eyes, etc. The two columns of snaps 11, 11*a*, 11*b*, 11*c*, 11*d* and 12, 12*a*, 12*b*, 12*c*, 12*d* can be secured directly to the inseam 15 and outseam 16 of the garment in a conventional manner (e.g., sewing or other mechanical attachment). Alternatively, the two columns of fasteners 11, 11*a*, 11*b*, 11*c*, 11*d* and 12, 12*a*, 12*b*, 12*c*, 12*d* may be secured on opposing sides of the fabric 128*a* or separate strips of fabric, which will be secured to the inside surface of the garment in a conventional manner, such as sewing, gluing, ironing, etc.

The lowermost snap 11 in the first column may releasably connect to the remaining snaps 11*a*, 11*b*, 11*c*, 11*d* in the first column, and the lowermost snap 12 in the second column may releasably connect to the remaining snaps 12*a*, 12*b*, 12*c*, 12*d* in the second column. Therefore, if snaps 11*a*, 11*b*, 11*c*, 11*d* and 12*a*, 12*b*, 12*c*, 12*d* are male snaps (e.g., the ball portion of a ball and socket connector), the snaps 11, 12 would be the opposite and vice versa.

The snaps in each column are spaced apart a predetermined distance, which corresponds to the amount of length adjustment desired. In addition, snaps in each column (e.g., snaps 11, 12; snaps 11*d*, 12*d*; snaps 11*c*, 12*c*; snaps 11*b*, 12*b*; snaps 11*a*, 12*a*) are preferably the same distance from the hem 14.

When the garment length adjustment system 120 is installed on a garment, such as a pant leg, the length of the hem 14 may be adjusted to a desired length as described above with respect to the adjustment system 1 illustrated in FIGS. 1 and 2 by folding the original hem 14 upwards so that the snaps 11, 12 releasably engage one of the corresponding snaps in each column on the inseam 15 and outseam 16. Each end of the drawstring cord 129*a* can then be pulled to draw the bottom of the hem 14 between the inseam 15 and outseam 16 up to the desired level. The fastener 124*a*, 124*b* are then releasably connected to the corresponding fastener 122*a*, 122*b*, each located above the column of snaps. Alternatively, where the garment length adjustment system 120 is installed on both the front and back inside surfaces of the garment, each end of cord 129*a* on the front of the garment may be releasably attached to a respective end of cord 129*a* on the back of the garment by, for example, utilizing mating fasteners or hooks on the respective ends of the cords 129*a*.

After the garment is adjusted to the desired length, any excess slack in the cord 129*a* can be reduced by doubling it back upon itself through the slack adjusting mechanism in the same manner that slack is adjusted in a helmet, brassiere or the like. The cord 129*a* is preferably laced through the fasteners 124*a*, 124*b* so that the fasteners remain in their desired positions when the length of the cord is adjusted.

While this exemplary embodiment has been described and illustrated in FIG. 12, it is understood that the number and position of the snaps 11, 11*a*, 11*b*, 11*c*, 11*d*, 12, 12*a*, 12*b*, 12*c*, 12*d* and fasteners 122*a*, 122*b* on the garment are exemplary and non-limiting. A different number and position of snaps 11, 11*a*, 11*b*, 11*c*, 11*d*, 12, 12*a*, 12*b*, 12*c*, 12*d* and fasteners 122*a*, 122*b* can be utilized in accordance with this disclosure. For example, the lowermost snaps 11, 12 may be positioned lower on the inseam 15 and outseam 16. Similarly, the fasteners 122*a*, 122*b* may be positioned higher on the inseam 15 and outseam 16 and/or a plurality of fasteners 122*a*, 122*b* may be positioned at various heights on the inseam 15 and outseam 16.

To the extent that the disclosed systems or components thereof are sewn onto the inside surface of the garment, it is desirable to do so in a manner that is not noticeable from the outside of the garment. A preferred stitch that will accomplish this is a hem stitch.

Having described and illustrated the principles of this application by reference to one or more preferred embodiments, it should be apparent that the preferred embodiment(s) may be modified in arrangement and detail without departing from the principles disclosed herein and that it is intended that the application be construed as including all such modifications and variations insofar as they come within the spirit and scope of the subject matter disclosed herein. It is understood that that the various embodiments disclosed herein may be used individually or combined with other embodiments.

What is claimed is:

1. A garment hem adjustment system, comprising:

a plurality of fasteners mounted on a surface of a garment proximal to the hem of the garment, the fasteners being aligned in a first column along an inseam of the garment and in a second column along an outseam of the garment;

the fasteners being spaced apart a predetermined distance corresponding to a desired adjustment of the garment hem;

the lowermost fastener in the first and second columns being adapted to releasably connect to the remaining fasteners; and a pulley system comprising a plurality of rings located on the garment surface proximal to the garment hem, the rings being aligned in at least two rows between the first and second columns; and a drawstring extends through the rings so that tension exerted on at least one end of the drawstring causes the garment hem between the columns of fasteners to be drawn up evenly against the garment surface to prevent the hem from sagging when the lowermost fastener in each column is releasably connected to another fastener in the column.

2. The garment hem adjustment system according to claim 1, further comprising a drawstring fastener attached to one end of the drawstring, the drawstring fastener being adapted to releasably connect to another fastener to maintain a desired tension on the drawstring so that the garment hem does not sag when the lowermost fastener in each column is releasably connected to another fastener in the column.

3. The garment hem adjustment system according to claim 2, further comprising a plurality of mating fasteners positioned on the inner surface of the garment and adapted to releasably connect to the drawstring fastener, the position of each mating fastener corresponding to a predetermined amount that the garment hem between the column of fasteners is drawn up when the drawstring fastener is releasably connected to that mating fastener.

4. The garment hem adjustment system according to claim 3, wherein the amount that the garment hem is drawn up when the drawstring fastener is releasably connected to a mating fastener corresponds to the distance that the garment hem is adjusted when the lowermost fastener in the first and second columns is to releasably connected to another fastener in the first and second columns.

5. The garment hem adjustment system according to claim 1, wherein the rings of the first row are offset from the rings of the second row.

6. The garment adjustment system according to claim 1, further comprising a slack adjustment mechanism, wherein the slack adjustment mechanism is located near an end of the drawstring, the drawstring adapted to lace through the slack adjusting mechanism to permit the drawstring to double back upon itself.

7. The garment hem adjustment system according to claim 1, further comprising a strip of fabric material on which the plurality of fasteners are mounted, wherein the strip of fabric material is secured to the garment surface proximal the garment hem.

8. The garment hem adjustment system according to claim 1, further comprising a strip of fabric material on which the pulley system is mounted, wherein the strip of fabric material is secured to the garment surface proximal the garment hem.

9. The garment hem adjustment system according to claim 8, wherein the plurality of fasteners are mounted on the strip of fabric material.

10. A garment hem adjustment system, comprising:

a plurality of fasteners mounted on a surface of a garment proximal to the hem of the garment, the fasteners being aligned in a first column along an inseam of the garment and in a second column along an outseam of the garment;

the fasteners being spaced apart a predetermined distance corresponding to a desired adjustment of the garment hem;

the lowermost fastener in the first and second columns being adapted to releasably connect to the remaining fasteners; and a cord attached to the garment proximal the garment hem between the inseam and outseam, the cord having a first end proximal the inseam and a second end proximal the outseam, each end terminating in a cord fastener, wherein the cord fasteners are adapted to releasably connect to another fastener to prevent the garment hem from sagging between the inseam and outseam when the lowermost fastener in each column is releasably connected to another fastener in the column.

11. The garment hem adjustment system according to claim 10, wherein each cord fastener is adapted to releasably connect to one of the fasteners in the first and second columns.

12. The garment hem adjustment system according to claim 11, further comprising at least one resting fastener mounted on a surface of a garment proximal to the hem of the garment, wherein the cord fastener is releasably connected to the resting fastener to hold the cord in place when the garment hem is fully extended.

* * * * *